US005967696A

United States Patent [19]

Allen et al.

[11] Patent Number: 5,967,696

[45] Date of Patent: Oct. 19, 1999

[54] RIDING TROWEL WITH VARIABLE RATIO TRANSMISSION

[75] Inventors: J. Dewayne Allen; Timmy D. Guinn, both of Paragould, Ark.

[73] Assignee: Allen Engineering Corporation, Paragould, Ark.

[21] Appl. No.: 09/008,355

[22] Filed: Jan. 16, 1998

[51] Int. Cl.[6] ..... E01C 19/22

[52] U.S. Cl. ..... 404/112; 474/8; 474/18; 474/46

[58] Field of Search ..... 404/112; 474/11, 474/12, 17, 18, 37, 46, 150, 8

[56] References Cited

U.S. PATENT DOCUMENTS

| | | | |
|---|---|---|---|
| D. 323,510 | 1/1992 | Allen et al. | D15/10 |
| 3,936,212 | 2/1976 | Holtz, Sr. et al. | 404/112 |
| 4,046,484 | 9/1977 | Holtz, Sr. et al. | 404/112 |
| 4,312,603 | 1/1982 | Whiteman, Jr. | 404/112 |
| 4,556,339 | 12/1985 | Morrison | 404/112 |
| 4,676,691 | 6/1987 | Morrison | 404/112 |
| 4,710,055 | 12/1987 | Masses et al. | 404/112 |
| 5,108,220 | 4/1992 | Allen et al. | 404/112 |
| 5,480,257 | 1/1996 | Allen | 404/112 |
| 5,480,258 | 1/1996 | Allen | 404/112 |
| 5,613,801 | 3/1997 | Allen | 404/112 |
| 5,685,667 | 11/1997 | Allen | 404/112 |

OTHER PUBLICATIONS

"Hi–Lo Variable Speed Pulley Drives" brochure by Hi–Lo Manufacturing Co. Prtd. Nov. 1994.

"TS 78 Multi–Lap Ride–On Power Trowel" Spec Sheet by Bartell Powell Products.

Bartell "Power Trowels" Brochure .

Speed Selector Inc.'s "Variable Speed Drives & Accessories" Brochure form 910–1–9.

*Primary Examiner*—James A. Lisehora

*Attorney, Agent, or Firm*—Stephen D. Carver

[57] ABSTRACT

A powered concrete finishing trowel comprises a variable ratio drive train to power one or more revolving rotors. One or more internal combustion motors power two or more downwardly projecting rotors comprising blades that frictionally contact the concrete surface. The rotors are shaft driven by reduction gear boxes. By tilting the rotors steering forces are developed. A variable gear drive unit comprises a variable ratio pulley driven by the motor. A second pulley drives the gear box input shaft, with a drive belt entrained between the pulleys. A linear actuator projecting outwardly from a stationary mounting plate terminates at a bracket assembly whose opposite end is pivoted to a rigid stabilizer that structurally compliments the linear actuator, establishing a fulcrum action applied to the bracket center. The linear actuator deflects the bracket assembly to axially displace portions of the variable ratio pulley to change the effective pulley diameter. Concurrently, belt tension enables axial movement of the lower pulley halves, changing its effective diameter in response to drive belt pressure. The varying ratio between effective pulley diameters establishes a variable drive gear ratio.

2 Claims, 4 Drawing Sheets

RIDING TROWEL WITH VARIABLE RATIO TRANSMISSION

BACKGROUND OF THE INVENTION

I. Field of the Invention

The present invention relates generally to motorized concrete finishing trowels. More particularly, the present invention relates to motor powered riding trowels of the type classified in United States Patent Class 404, Subclass 112.

II. Description of the Prior Art

It has long been recognized by those skilled in the art that freshly placed concrete must be appropriately finished. Proper and timely finishing insures that desired surface characteristics including appropriate smoothness and flatness are achieved. Motorized riding trowels are ideal for finishing large very areas of plastic concrete quickly and efficiently, and such trowels are rapidly becoming the industry standard.

A typical power riding trowel comprises two or more bladed rotors that project downwardly and frictionally contact the concrete surface for finishing. These rotors are driven by one or more motors mounted on the frame. The motors drive suitable reduction gearboxes (i.e., 20:1 reduction) to revolve the rotors. The riding trowel operator sits on top of the frame and controls trowel movement with a steering system that tilts the axis of rotation of the rotors. The weight of the trowel and the operator is transmitted frictionally to the concrete by the revolving blades. The unbalanced frictional forces caused by rotor tilting enable the trowel to be steered.

Holz, in U.S. Pat. No. 4,046,484 shows a pioneer, twin rotor, self propelled riding trowel. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Pat. No. Des. 323,510 owned by Allen Engineering Corporation.

Allen Engineering Corporation U.S. Pat. No. 5,613,801 issued Mar. 25, 1997 discloses a power riding trowel equipped with twin motors. The latter design employs a separate motor to power each rotor. Steering is accomplished with structure similar to that depicted in U.S. Pat. No. 5,108,220 previously discussed.

Allen U.S. Pat. No. 5,480,257 depicts a twin engine powered riding trowel whose guard structure is equipped with an obstruction clearance system. When troweling areas characterized by projecting hazards such as pipes or ducts, or when it is necessary to trowel hard-to-reach areas adjacent walls or the like, the guard clearance structure may be retracted to apply the blades closer to the target region.

Allen U.S. Pat. No. 5,685,667 depicts a twin engine riding trowel using "contra rotation." For enhanced stability and steering, the rotors rotate in a direction opposite from that normally expected in the art.

As freshly poured concrete "sets," it soon becomes hard enough to support the weight of the specialized finishing trowel, so pan finishing can begin. By starting panning while concrete is still "green," within one to several hours after pouring depending upon the concrete mixture involved, "super-flat" and "super-smooth" floors can be achieved. The advent of more stringent concrete surface finish specifications using "F" numbers to specify flatness (ff) and levelness (fl), dictates the use of pans on a widespread basis.

The panning process comprises three different recognizable stages. In the initial "brake open" stage, the rotors are ideally driven between 40 and 65 RPM. As the concrete hardens, the pan floating stage occurs, involving rotor speeds between 70 and 95 RPM. The last phase of pan floating, the "fizz stage," uses an increased rotor speed of between 95–125 RPM. At present these RPM requirements are achieved simply by varying motor speed.

Pan finishing is normally followed by medium speed blade finishing, after the pans are removed from the rotors. A developing technique is the use of "combo blades" during the intermediate "fuzz stage" as the concrete continues to harden. So-called "combo-blades" are a compromise between pans and normal finishing blades. They present more surface area to the concrete than normal finishing blades, and attack at a less acute angle. The rotors are preferably turned between 100 to 135 RPM at this time. Finishing blades are then used, and they are rotated between 120 to 150 RPM. Finally, the pitch of the blades is changed to a relatively high contact angle, and burnishing begins. This final trowel finishing stage uses rotor speeds of between 135 and 165 RPM.

Modern large, high power riding trowels are noted for their speed, horsepower, and efficiency. Such trowels, however, are not without weaknesses. For example, the drive train and the high power motors are subject to substantial stress during operation. Motor loading varies as the rotor RPM requirements change. The motors function most efficiently at a given operating point in their characteristic horsepower-RPM and torque-RPM curves. Especially with diesel engines, optimum torque and horsepower requirements are achieved over a limited RPM range.

The engines on most riding trowels directly power the reduction drive gear boxes connected to the rotor shafts. The incoming shaft speed of the conventional rotor gear box is the same as the motor RPM. The output shaft speed (i.e., rotor speed) is geared down, approximately 20:1. Engine RPM is usually the key variable elated to output power. But if the engine speed increases too much, excessive power may be developed and the finishing mechanism may rotate too fast. For example, the initial panning stage requires relatively high power because of the viscous character of the still-wet concrete, but relatively low rotor speeds are desired. Since the rotors are driven through a fixed ratio, established by the gearbox and pulleys, optimum engine power often cannot be obtained during panning without risking excessive rotor speeds.

It is thus desirable to provide a riding trowel wherein the engine and gear boxes can operate at ideal speeds over a wide range of finishing conditions. Although it has been suggested by others in the finishing trowel industry (i.e., Bartell Industries) to vary gear box input shaft speeds with a "high-low" or "torque converter" attachment, we are aware of no prior art means for reliably providing a continuously variable gear box drive system that holds a given user-selected gear ratio during the different pan and blade finishing stages discussed above. An appropriate variable ratio drive train must be compatible with existing trowel motors, frames and gear boxes to minimize cost. Further, it must not overly complicate the drive train so that operating efficiency and reliability are preserved.

SUMMARY OF THE INVENTION

This invention provides a variable ratio drive train concept to powered concrete finishing trowels. The concept may be applies to single engine or multiple engine riding trowels, or to single engine walk behind trowels. While ideal for diesel applications, it is equally viable with gasoline powered motors.

The preferred riding trowel comprises one or more engines for powering downwardly projecting rotors whose blades frictionally contact the concrete surface. The rotors are driven by reduction gear boxes that are shaft activated. By tilting the rotors steering forces are developed. A variable gear drive unit comprises a variable ratio pulley driven by the motor. A second pulley drives the gear box input shaft. A drive belt is entrained between the pulleys.

A rigid plate secured to the motor mounts the actuator unit. A linear actuator projects outwardly from the plate, terminating in a connection to a bracket assembly. The opposite end of the bracket system is pivoted to a rigid, stabilizer secured to the trowel frame. The stabilizer structurally compliments the linear actuator, establishing spaced-apart a fulcrum that pressures the bracket center. The bracket assembly center portion is thus deflected to axially displace portions of the motor driven variable ratio pulley. When the linear actuator deflects the bracket assembly the effective diameter of the motor-driven pulley is changed.

Concurrently, the varying drive belt tension enables the lower pulley to axially expand or contract its spacing, effectively changing its effective diameter to accommodate the drive belt. The ratio between effective pulley diameters, which establishes the drive gear ratio, is thus variable. Hence the trowel rotors may be driven at a desired user-selected RPM while the motors are allowed to operate within an optimum power band.

Thus a basic object of our invention is to enable trowel rotors to operate at a variety of speeds while allowing the drive motors to stay within optimum limits.

A related object is to provide a continuously variable, rotor drive gear ratio for power finishing trowels.

Another important object is to provide means whereby motor speed can be optimized during trowel finishing even though rotor speeds are varied.

Conversely, an important object is to enable rotor speed to be varied substantially as desired during different finishing stages, while maintaining optimum motor speed and motor torque.

Another basic object of our invention is to provide an optimum gear ratio at all times during the finishing process.

Another important object is to lock the drive train into different gear ratios that are selected during different finishing stages to maintain the desired operating parameters.

A further object is to maximize engine efficiency.

A related object is to provide a continuously variable trowel gearing system that is ideal for either panning or blading.

A still further object of our invention is to provide a riding trowel that increases production and efficiency.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
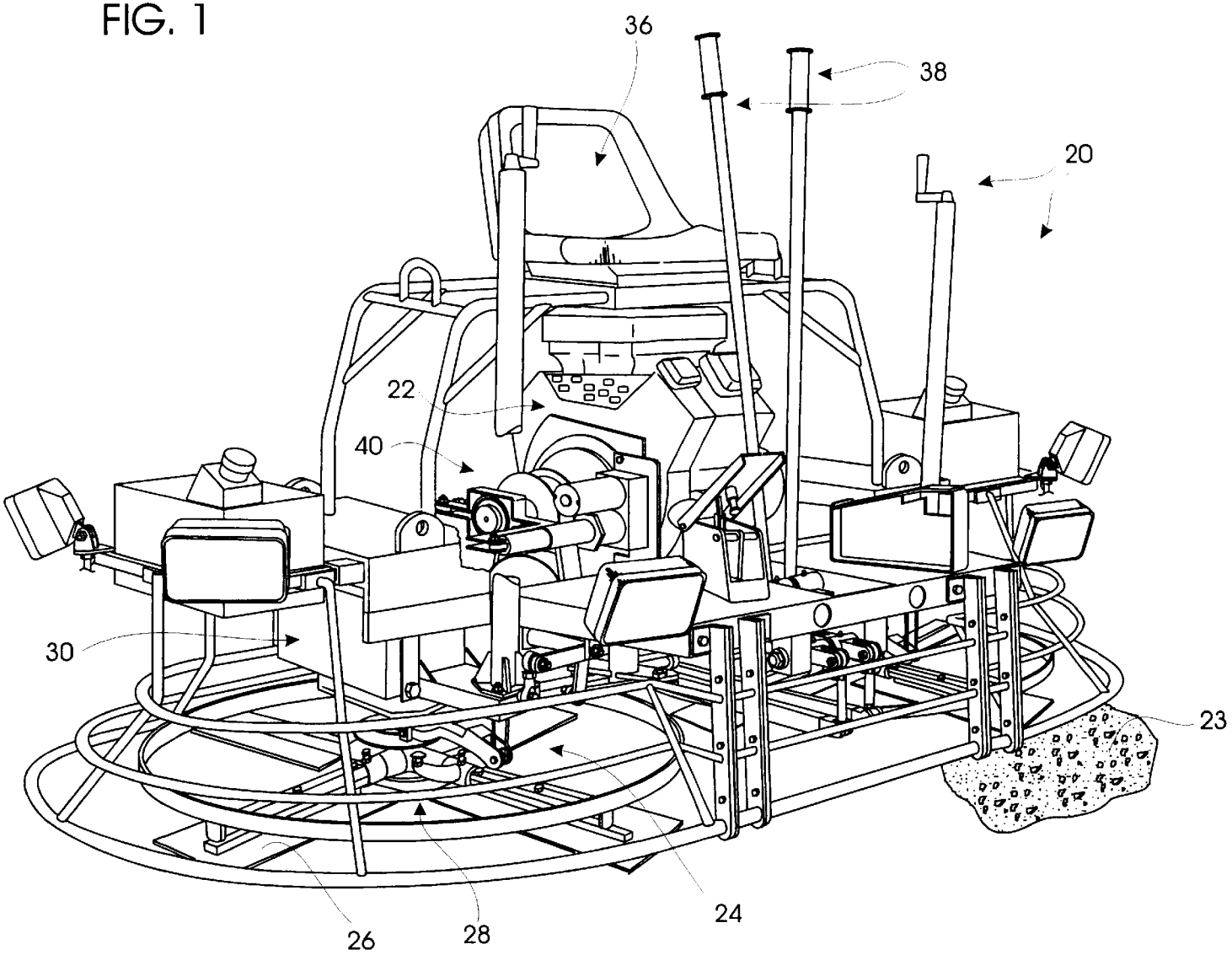
FIG. 1 is a front pictorial view of a typical riding trowel equipped with our continuously variable gearing system, with portions thereof shown in section or omitted for clarity.

FIG. 1 shows a typical riding trowel 20 incorporating our new variable gearing system. Common structural details relating to riding trowel motors, rotors, steering, rotor tilting, steering linkages, rotor configuration, blade construction and the like are set forth in prior U.S. Pat. Nos. 5,108,220, 5,613,801, 5,480,257, and 5,685,667, all owned by Allen Engineering Corporation. For disclosure purposes, the descriptive sections of the aforementioned Allen patents, and the previously described Holz patents, U.S. Pat. Nos. 4,046,484 and 3,936,212, are hereby incorporated by reference as if fully set forth herein.

As explained in detail in one or more of the last mentioned patent references, each riding trowel comprises one or more engines 22 for powering downwardly projecting, bladed rotors 24 that frictionally contact the concrete surface 23 to be treated. Each rotor 24 comprises a plurality of radially spaced apart blades 26 that project from central hubs 28 that are driven by gear boxes 30. The steering system may include a plurality of both manual and hydraulic linkages and actuators. By tilting the rotors appropriately, directional steering forces are developed. The operator's seat 36 may be mounted above the motors proximate steering handles 38.

The variable gear drive unit 40 (FIGS. 1–3) is secured atop the frame by a rigid mounting plate 41 preferably attached to the engine. Equipment of this general nature is available from the Hi-Lo Manufacturing Company, Minneapolis Minn. The internal combustion motor drives a variable ratio pulley 44 coaxially coupled to the exposed flywheel 46 (FIG. 4). The axis of rotation of pulley 44 and flywheel 46 are coincident, i.e., they lie within the same line. Each gear box 30 is driven by an incoming shaft 50 that is driven by a lower, variable drive pulley 52 (i.e., comprising part of gear drive unit 40). The opposite end of shaft 50 may be terminated in a suitable pillow block 51, or it may extend to another gear box in the case of single engine riding trowels. A drive belt 55 is entrained between pulleys 44 and 52. Gearbox output shaft 58 extends downwardly from its reduction gearbox 30 for driving a rotor 24. The gearbox reduces shaft speed approximately 20:1 in the best mode. Further reduction from motor RPM speed is accomplished by the pulleys 44, 52.

Figure 3:
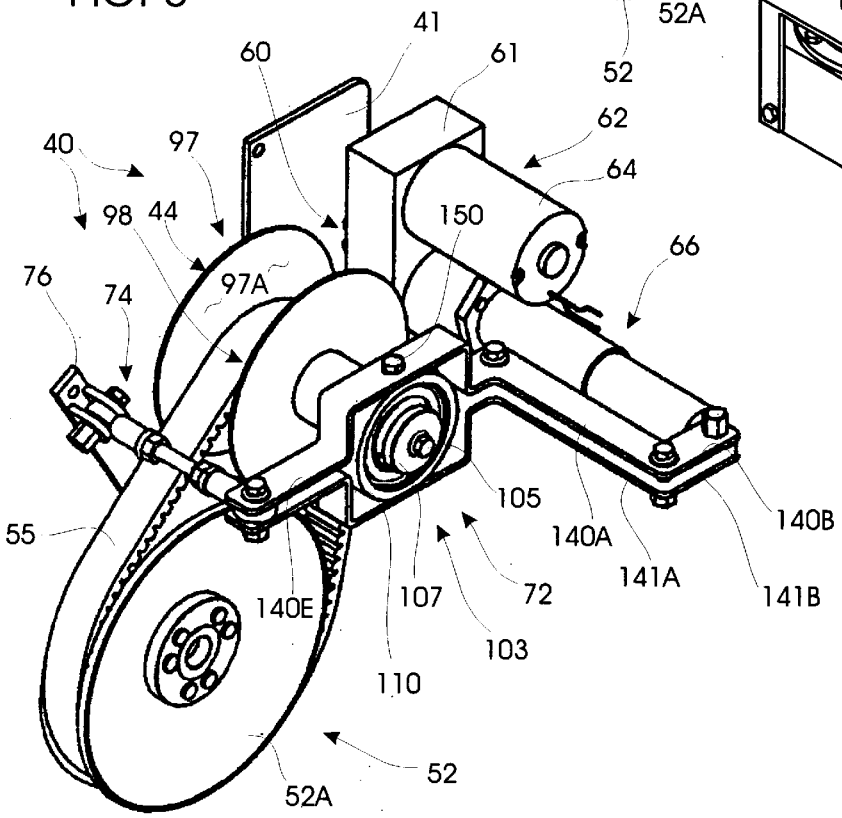
FIG. 3 is an enlarged fragmentary, isometric view of the preferred continuously variable gear system of FIG. 2.
Figure 4:
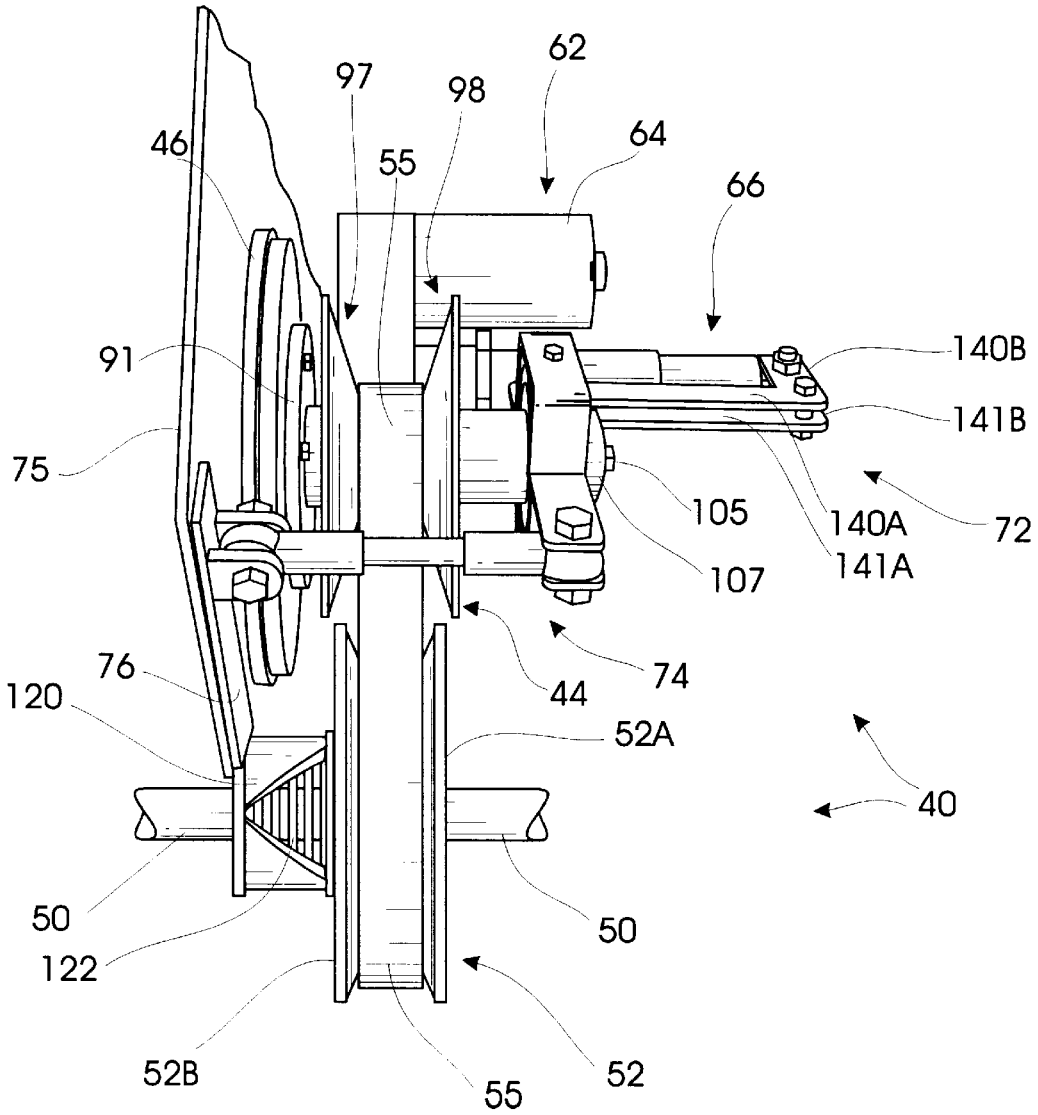
FIG. 4 is a fragmentary, front plan view of the preferred continuously variable gear system, with portions broken away or omitted for clarity; and, FIG. 5 is an exploded isometric view of the preferred continuously variable gear system.
Figure 5:
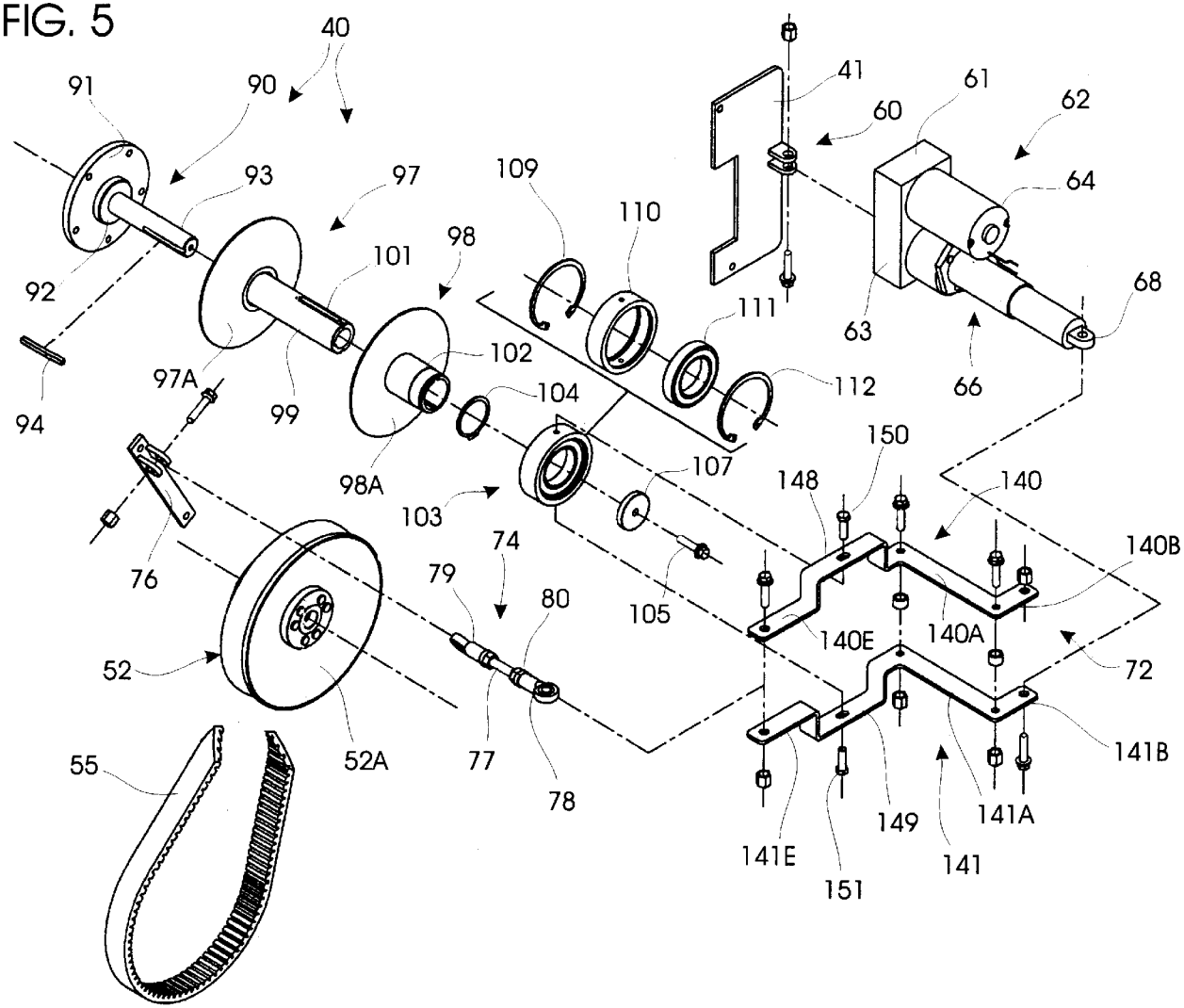

With primary reference now directed to FIGS. 3–5, the gear unit 40 is preferably secured to the trowel frame adjacent a motor by a substantially rectangular, actuator mounting plate 41. Mounting plate 41 includes tabs 60 that pivotally mount the base 61 of linear actuator 62, comprising part of the actuator means. The actuator motor 64 is electrically powered. Through its internal gearing an expansible cylinder 66 is driven. A tab 68 projecting from cylinder 66 is pivotally coupled to one end of an actuator bracket assembly, generally designated by the reference numeral 72 (FIG. 3). The opposite end of the actuator bracket assembly 72 is coupled to a rigid, stabilizer 74 that also comprises part of the actuator means. Stabilizer 74 pivotally terminates at a bracket 76 preferably secured to the starter mounting plate 75 (FIG. 4) immediately adjacent the internal combustion motor. The stabilizer 74 structurally compliments linear actuator 66, and enables bracket assembly 72 to activate the pulley system. A fulcrum effect is achieved, and the resultant forces at the middle of the bracket assembly 72 applies force to the upper pulley. This normally fixed length linkage 74 (i.e., a "Heim" joint) is threadably adjustable. Its intermediate, threaded shaft portion 77 is threadably received by terminal portions 78, 79, that can be locked by tightening nuts 80.

Thus a rocking action is established approximately at the middle of the bracket 72 when linear actuator 66 is activated. This action controls the selected ratio of the variable ratio pulley 44, and the resultant gear ratio established by the combination of pulleys 44 and 52. When the linear actuator deflects the bracket assembly 72, the effective diameter of pulley 44 is varied directly. At the same time, varying tension in the drive belt allows the effective diameter of the lower, gearbox-driving pulley to vary, as will be hereinafter described.

The upper pulley 44 comprises a terminal disk assembly 90 to be driven by the motor. A coupling disk 91 mounts a center collar 92 and a projecting, keyed shaft 93. Key 94 torsionally locks the pulley section half 97 when shaft 93 is fitted into hollow stub 99. A similar key on stub 99 torsionally locks it within hub 102 on pulley half 98, but allows limited axial movements of pulley half 98 on shaft 99. Pulley halves 97, 98 comprise convex disk members 97A, 98A respectively that are concentrically aligned and aimed at one another. The inner surfaces of these variably spaced apart disk members project outwardly and angularly away from the center zone where the belt is entrained, so that as the halves are moved closer together or further apart, the effective diameter of the pulley varies.

A bearing assembly 103 is concentrically mounted to hub 102, and locked in place with snap ring 104. The end of shaft 93 receives anchor bolt 105 that compresses washer 107 to complete the assembly. As best seen in FIG. 5, bearing 103 comprises an inner bearing 111 sandwiched within a yoke 110 by snap rings 109 and 112.

Figure 2:
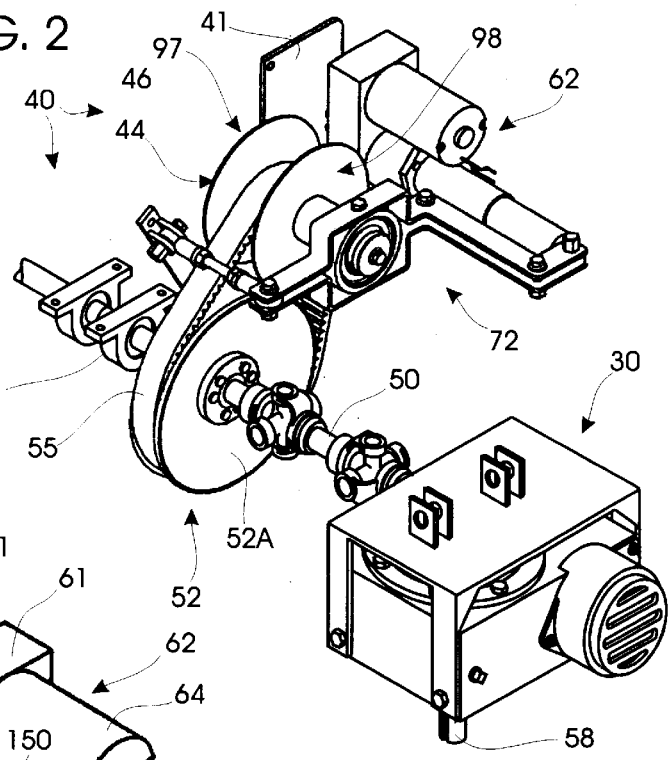
FIG. 2 is an enlarged, fragmentary, isometric view showing the preferred power train.

Referring to FIG. 4, lower pulley assembly 52 also varies in effective diameter. However, it is not directly driven by the bracket assembly 72. It comprises a pair of axially spaced part, concentric disk halves 52A, 52B. Both halves project a convex, disk towards the center zone occupied by the drive belt. Half 52A is torsionally fixed on gearbox drive shaft 50 (FIG. 2). A dog 120 and a concentric spring 122 control the inner half 52B. Disk half 52A moves towards or away from half 52B, depending upon yieldable bias from spring 122 and the applied drive belt pressure.

With primary attention directed once more to FIG. 5, bracket assembly 72 comprises a pair of similar, spaced part brackets 140, 141. Each bracket has an offset leg portion 140A, 141A coupled at its foot 140B, 141B to the linear actuator discussed previously. The opposite feet 140E, 141E are coupled to the normally fixed length linkage 74 previously discussed. The vertically offset center portions 148, 149 of brackets 140, 141 respectively "clear" and are fastened to the bearing yoke 110 previously discussed with fasteners 150, 151. This allows the center of the bracket assembly to swivel slightly as the assembly is deflected by the linear actuator.

Thus the effective diameter of motor drive pulley 40 is varied by the linear actuator, which elongates or contracts to displace bracket assembly 72. As the brackets pivot accordingly, bearing 103 is axially pressured to either compress or uncompress the pulley 40. As pulley 40 is forcibly varied in diameter, belt pressure on the lower pulley assembly 52 causes it to yieldably assume a stable position, so belt length is accommodated, and a varying final gear ratio is achieved.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A power trowel for finishing concrete, said trowel comprising:

a rigid frame;

a seat disposed on the frame for an operator;

means accessible to a seated operator for controlling the trowel;

internal combustion motor means mounted on said frame for powering said trowel, said motor means comprising an output flywheel having an axis of rotation;

rotor means comprising a plurality of blades for treating a concrete surface, the rotor means projecting downwardly from said frame;

gear box means for driving said rotor means;

driveshaft means for turning said gear box means, the driveshaft means comprising an axis of rotation that is parallel with and spaced apart from said flywheel axis of rotation;

variable ratio means for coupling said motor means to said driveshaft means, said variable ratio means comprising:

first pulley means coaxially coupled to said flywheel and driven by said motor means;

second pulley means coupled to said driveshaft means for rotating the driveshaft means to activate said gearbox means;

at least one of said first and/or second pulley means comprising a deflectable portion adapted to be moved for changing the effective pulley drive diameter;

belt means for coupling said first and second pulley means together; and, bracket means for moving said deflectable portion thereby varying the effective diameter of at least said first pulley means to adjust the ratio between motor speed and the speed of said driveshaft, said bracket means comprising a center portion that applies axial pressure to said first pulley means and a pair of feet projecting from said center portion;

elongated power actuator means for displacing said bracket means, the actuator means extending from said motor means to one of said bracket means feet; and, means for stabilizing said variable ratio means by complementing said actuator means, said stabilizing means parallel with said actuator means and coupled to an opposite foot of said bracket means.

2. A power trowel for finishing concrete, said trowel comprising:

a rigid frame;

a seat disposed on the frame for an operator;

means accessible to a seated operator for controlling the trowel;

internal combustion motor means mounted on said frame for powering said trowel, said motor means comprising an output flywheel having an axis of rotation;

rotor means comprising a plurality of blades for treating a concrete surface, the rotor means projecting downwardly from said frame;

gear box means for driving said rotor means;

driveshaft means for turning said gear box means, the driveshaft means comprising an axis of rotation that is parallel with and spaced apart from said flywheel axis of rotation;

variable ratio means for coupling said motor means to said driveshaft means, said variable ratio means comprising:

first pulley means coaxially coupled to said flywheel and driven by said motor means, wherein the first pulley means comprises a deflectable portion adapted to be moved for changing the effective pulley drive diameter;

second pulley means coupled to said driveshaft means for rotating the driveshaft means to activate said gearbox means;

belt means for coupling said first and second pulley means together; and, bracket means for varying the effective diameter of at least said first pulley means to adjust the ratio between motor speed and the speed of said driveshaft, said bracket means comprising a center portion that applies axial pressure to said first pulley means and a pair of feet projecting from said center portion;

elongated power actuator means for displacing said bracket means, the actuator means extending from said motor means to one of said bracket means feet and;

means for stabilizing said variable ratio means by complementing said actuator means, said stabilizing means parallel with said actuator means and coupled to an opposite foot of said bracket means.

* * * * *